US006457265B1

(12) United States Patent
Lepage et al.

(10) Patent No.: US 6,457,265 B1
(45) **Date of Patent: *Oct. 1, 2002**

(54) SPORT BOOT

(75) Inventors: Francis Lepage, Lyons; Bertrand Barre, Lapeyrouse, both of (FR)

(73) Assignee: Lange International S.A., Fribourg (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,393

(22) Filed: Sep. 8, 1998

(30) Foreign Application Priority Data

Sep. 9, 1997 (CH) ..... 2108/97

(51) Int. Cl.[7] ..... A43B 5/04
(52) U.S. Cl. ..... 36/117.1; 36/117.6; 36/115
(58) Field of Search ..... 36/115, 117.1, 36/117.6, 119.1, 118.2, 89, 92, 109

(56) References Cited

U.S. PATENT DOCUMENTS 3,718,994 A * 3/1973 Spier
3,807,062 A * 4/1974 Spier
3,877,158 A * 4/1975 McCutchan, II
4,523,394 A * 6/1985 Lindh et al.
5,189,815 A * 3/1993 Pozzobon et al.
5,498,033 A * 3/1996 Hoshizaki et al.
5,588,228 A * 12/1996 Foscaro et al.
5,667,737 A 9/1997 Wittmann

FOREIGN PATENT DOCUMENTS

| | | |
|---|---|---|
| EP | 0 645 101 A | 3/1995 |
| EP | 0 774 217 A | 5/1997 |
| FR | 2 119 653 A | 8/1972 |
| FR | 2 668 072 A | 4/1992 |

* cited by examiner

*Primary Examiner*—Ted Kavanaugh
(74) *Attorney, Agent, or Firm*—Bugnion S.A.; John Moetteli

(57) ABSTRACT

A boot has a rigid core (1, 2) consisting, in some areas, of the inside surface of the boot into which a liner is received and of an envelope of supple material (11, 12) covering the rigid core, and making up the inside surface of the boot in the areas where the rigid core is absent. The rigid core comprises means of reinforcement (3, 4, 5, 6, 7) that are not covered by the aforementioned envelope of supple material (11, 12).

9 Claims, 2 Drawing Sheets

SPORT BOOT

FIELD OF THE INVENTION

The present invention concerns a sport boot, particularly intended for gliding boards such as skis, snowboards, or ice-skates. On the one hand, it shows a rigid core consisting, in some areas, of the inside of the boot that receives a liner. On the other hand, it shows an envelope of supple material covering the rigid core, and making up the inside of the boot in the areas where the rigid core is absent.

PRIOR ART

Such sport boots are known in prior art, for example, in the patents FR 2.119.653 and U.S. Pat. No. 5,588,228.

The patent FR 2.119.653 describes a ski boot consisting of a rigid interior part and a supple exterior part. The rigid interior part of this boot has the form of a continuous shell intended to entirely surround the skier's foot, and the wear- and abrasion-resistant exterior part is meant to protect the interior part of the boot.

The patent U.S. Pat. No. 5,528,228 describes a ski boot consisting of a rigid core cut in such a way as to form a rigid triangulated structure in two parts; one part making the shell of the boot, and the other part the cuff of the boot. This rigid core of the boot is covered by a supple envelope; the attachment between the core and the supple envelope being made during injection or by mechanical means. The rigid frame of the boot consists of a rigid triangulated structure whose role is an optimal transmission of the efforts between the leg and the binding. The rigid triangulated core of the shell has the general shape of an upside-down <<Y>>, one of whose branch is oriented toward the front of the boot, the other branch is directed toward the heel of the boot, and the foot of the <<Y>> is connected with the boot's cuff. Thus, the efforts are distributed over the boot's front and heel, which are also the places where the boot is attached to the skis in case of a ski boot.

SUMMARY OF THE INVENTION

The purpose of the present invention is to improve sport boots presently known as state of the art.

The present invention more particularly consists in improving a boot whose rigid core is directly in contact with the liner by increasing the transmitted efforts, and bettering the guiding precision.

According to the invention, the boot is a high rigidity boot, of competition type, whose rigid core is in direct contact with the liner surrounding the user's foot. It is characterized in such a way that the rigid core consists of means of reinforcement, which is not covered by the envelope of supple material.

According to the invention, the boot distinguishes itself from boots of prior art in that it comprises three different areas: one supple zone, one rigid zone, and one rigid and reinforced zone.

Furthermore, it offers the advantage of creating a direct contact between the rigid core and the liner, which increases the guiding precision.

The means of reinforcement are placed in areas of the boot where important efforts are transmitted, and they form a general guy structure improving the back support and the transmission of the lateral efforts. Depending on their location on the boot, the means of reinforcement can also have a protective effect on the boot.

According to a first embodiment, the means of reinforcement consists in reinforcing the cuff's back and shell's back of the boot.

According to a second embodiment, the means of reinforcement also comprises a diagonal reinforcement strip on at least one side of the boot. The reinforcement strip is composed of two parts: one being located on the shell, and the other, on the cuff of the boot.

According to a variant of the second embodiment, the means of reinforcement comprises a diagonal reinforcement strip on each side of the boot.

According to a third embodiment, the boot consists of one support on at least one of the front sides of the boot's shell forming a pole deflector.

According to a fourth embodiment, the means of reinforcement also consists of a vibration-damping element.

According to another variant, the boot is a one-piece type. In this variant, the envelope of supple material enables the creation of articulation zones on the boot.

The invention also concerns the manufacturing process of a boot. According to a first manufacturing process, the rigid core and the envelope of supple material are produced separately and assembled by fitting the two parts together.

According to a second manufacturing process, the rigid core and the envelope of supple material are molded together.

The fact that the means of reinforcement is not covered by the envelope of supple material, first, offers the advantage of not creating a material allowance on the boot in the areas where they are located, and second, of playing the role of protection in downhill racing.

Such allowances can indeed bother the user by repeated friction of these means against each other, particularly in the case of diagonal reinforcement strips on the inside of the boot. Moreover, the supple part can be damaged if it covers the support of the boot's front used as a pole deflector.

BRIEF DESCRIPTION OF THE DRAWINGS

The invention will be better understood thanks to the description of a non-restrictive embodiment and its related drawings.

DESCRIPTION OF THE PREFERRED EMBODIMENT(S)

Figure 2:
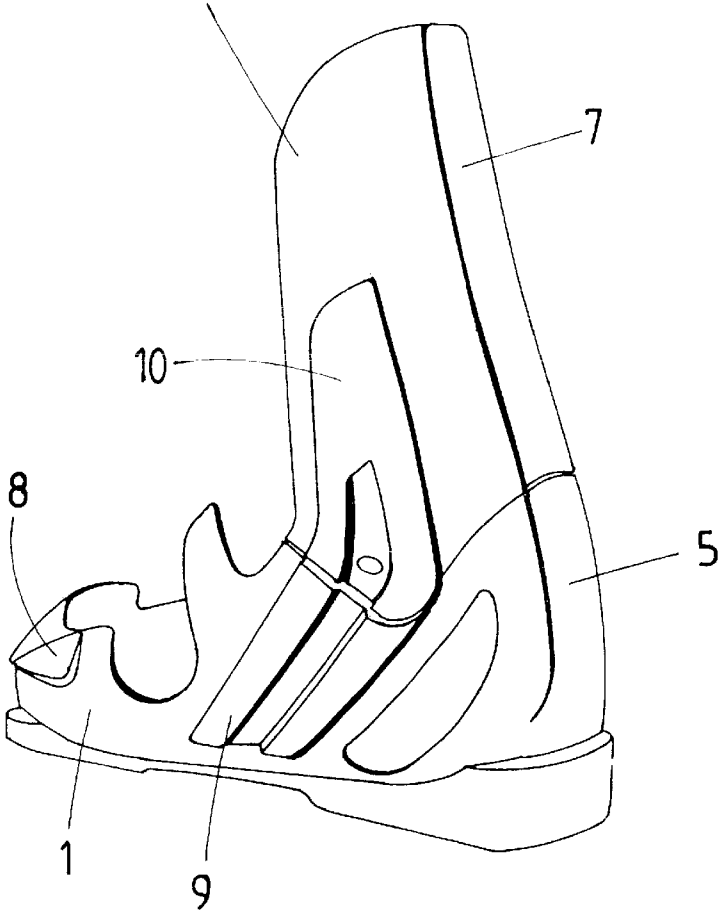
FIG. 2 is a back view in perspective showing the rigid core of a boot according to the invention.
Figure 1:
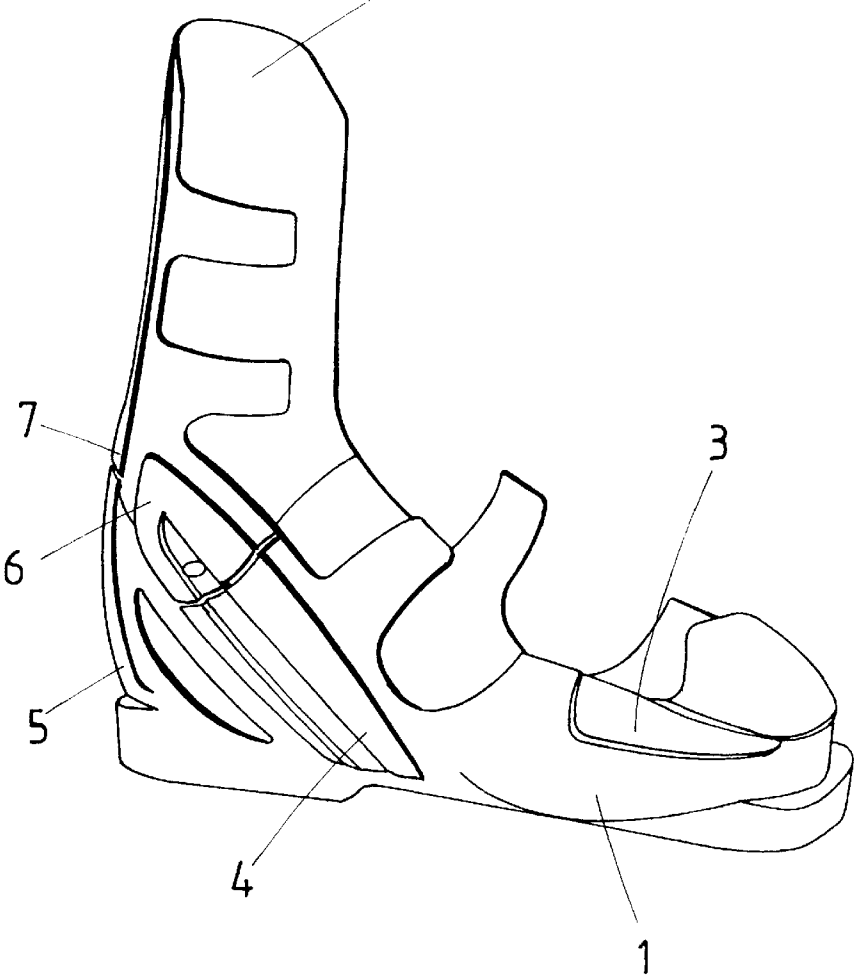
FIG. 1 is a side view in perspective showing the rigid core of a boot according to the invention.

A sport boot is provided which is particularly intended for gliding boards such as skis, snowboards, or ice-skates. Referring to FIGS. 1 and 2, the sport boot has a rigid core made up of an openwork shell 1 and a cuff 2, each having a similar associated hardness and consisting, in some areas, of the inside surface of the boot into which a liner (not shown) is received. The core is enveloped by supple, less hard materials 11 and 12, which make up the inside surface of the boot in the areas where the rigid core 1 or 2 is absent. The rigid core further includes means of reinforcement 3, 4, 5, 6, 7, 8, 9, and 10 that are not covered by the aforementioned envelope of supple material 11 or 12.

The core of the boot is first described in reference to FIGS. 1 and 2.

This core is composed of an openwork shell 1 intended to support and transmit the efforts of the skier's foot toward the ski, and of a cuff 2 articulated on the shell 1 and supporting the skier's ankle. Furthermore, the shell 1 comprises two lateral supports 4 and 9, a back support 5 placed at the level of the heel, and two front supports 3 and 8. The front supports 3 and 8 are especially used as pole deflectors and protect the boot's shell in case of shocks against the racing poles, for example. The lateral supports 4, 9 and the back support 5 of the shell 1 are extended on the cuff 2 through corresponding supports 6, 10 and 7. The lateral supports 4, 6, 9 and 10 form a diagonal strip on each side of the boot, which increases the lateral rigidity of the boot. The back supports 5 and 7 rigidify the press hold on the skier's heel, and they are extended through the sole of the boot.

The core of the boot represented in FIGS. 1 and 2 makes up the most rigid part of the boot, and the supports form guys which, thanks to their tensile strength, improve the back support of the boot. The position of these guys on the lateral sides of the boot enables a good distribution of the efforts and increases the guiding precision of the boot. In effect, the longitudinal efforts are primarily extended through the back supports 5, 7 and also through the lateral supports 4, 6, 9, 10, and the lateral efforts are extended through the lateral supports 4 and 6 or 9 and 10.

Figure 4:
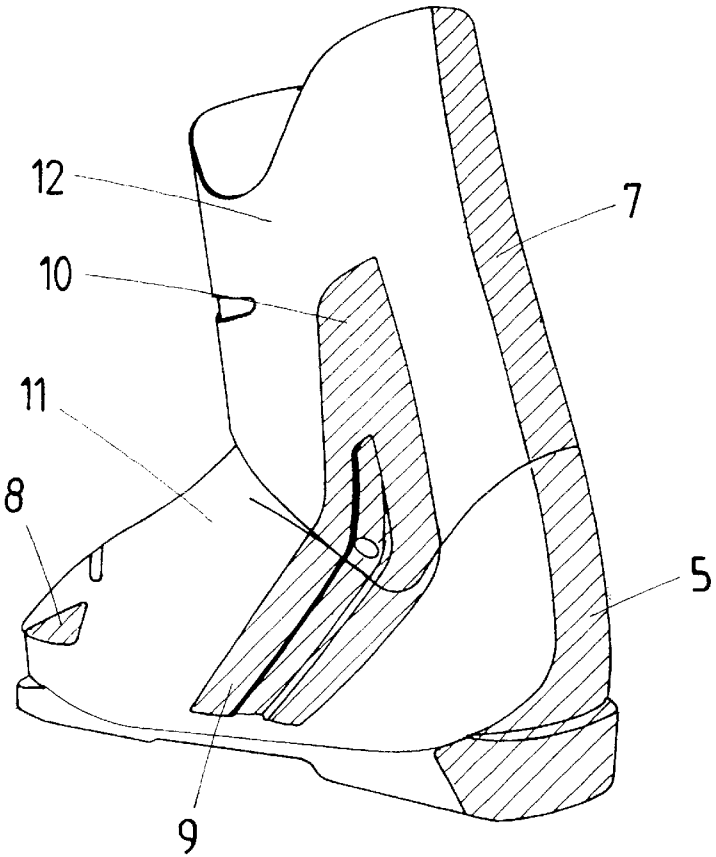
FIG. 4, according to the invention, is a back view in perspective showing a boot, whose core is covered by an envelope of supple material.
Figure 3:
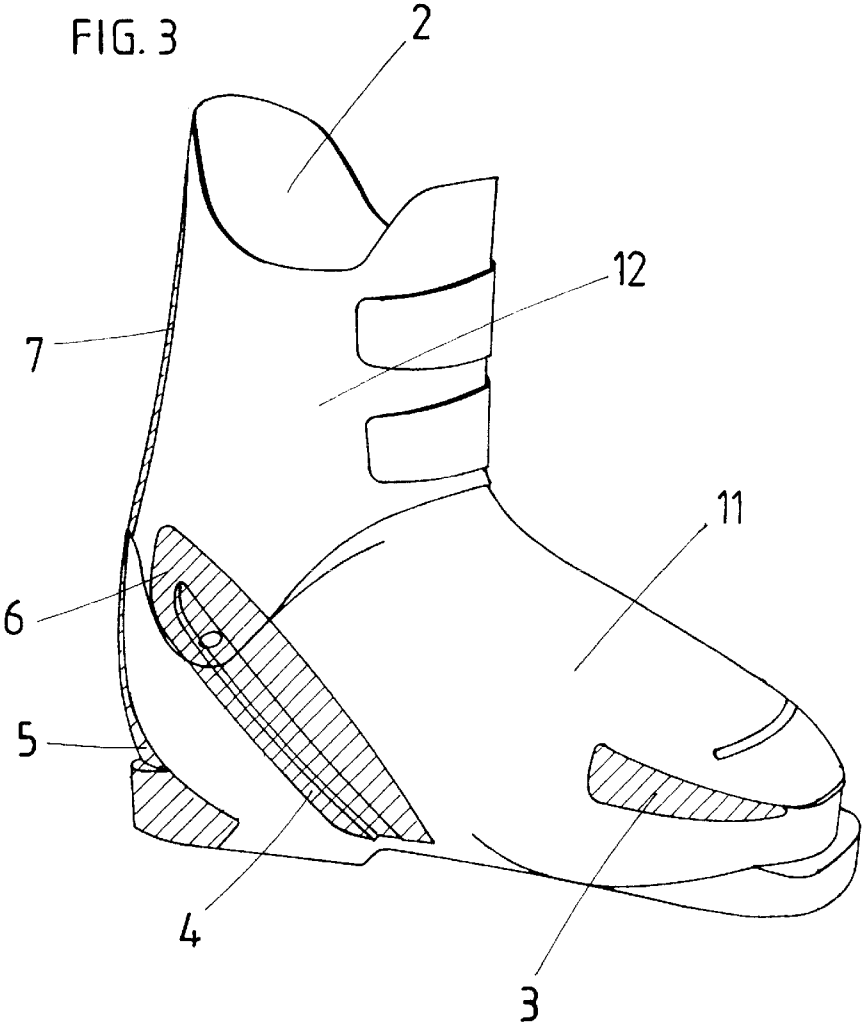
FIG. 3, according to the invention, is a side view in perspective showing a boot, whose core is covered by an envelope of supple material.

The FIGS. 3 and 4 represent two views of a boot, whose shell 1 and cuff 2 are partially covered by envelopes of supple material 11 and 12. The lateral supports 4, 9, 6, 10 and back supports 5, 7 are not covered by envelopes of supple material. They are consequently visible and cross-hatched on the drawings. The supple parts 11 and 12 cover the foot's top and leg's front of the user. These are the parts of the boot, which do not need to be as rigid as the rest of the boot.

The boot buckles are not represented in the figures. These buckles are of classic type and are attached to the rigid part of the boot.

The boot is manufactured with usual material, for example, polyurethane with a shD (Shore) hardness of 64 for the rigid part, and 50 for the envelope of supple material.

The means of reinforcement can be formed during molding of the shell 1 and the cuff 2 in providing for a material allowance in the areas determined in the mold. The means of reinforcement can also be attached after molding by means of mechanical fastening, such as screws or equivalent methods. Thus, in case of premature wear, especially for the front deflectors, the supports could be changed. Besides, different lateral supports with various rigidities could be provided so that the user of the boot has the choice between several models and can change or adjust them. Where reinforcements are not covered by the supple part 11 and 12, changing or replacing them is made easier.

Furthermore, it can be advantageous to attach vibration-damping elements to the means of reinforcement. Such vibration-damping elements were described in detail in patent FR 2 706 741 on behalf of the applicant. There are mainly composed of viscoelastic material associated with a rigid stressed part, which is attached to the means of reinforcement with the viscoelastic material.

The rigid stressed part has a modulus of elasticity E higher than $10^4$ Mpa and its material is chosen in the group containing aluminum or aluminum-zinc alloys, magnesium, glass or carbon reinforced laminated thermosetting materials or glass or carbon reinforced thermoplastic materials. The viscoelastic material is for example a butyl rubber or a synthetic elastomer, used alone, as a mixture or reinforced.

The invention can also apply to solid-bloc sport boots in which the shell and the cuff form one piece. Means of reinforcement similar to the ones previously described can be provided on such one-piece boots so as to form this particular guy structure. In such solid-bloc boots, the articulation axis between the shell and the cuff is replaced by the envelope of supple material, which creates zones of articulation.

The rigid core and the envelope of supple material are manufactured using classic state-of-the-art processes such as injection or multi-injection.

According to a first manufacturing process of the boot, the rigid core and the envelope of supple material are manufactured separately from one another and are then assembled by fitting the two parts together.

According to another manufacturing process of the boot, the rigid core and the envelope of supple material are molded together.

What is claimed is:

1. A boot for gliding sports having an inside surface which supports a wearer's foot, the boot having (a.) a rigid core (1, 2), the rigid core having a certain hardness and comprising a first portion of the inside surface of the boot, and (b.) an envelope of supple, less hard material (11, 12) at least partially covering the rigid core, and making up a second portion of the inside surface of the boot, wherein the rigid core comprises means of reinforcement (3, 4, 5, 6, 7, 8, 9, 10) disposed at least on the sides of the boot, the means of reinforcement extending through to the outside of the aforementioned envelope of supple material (11, 12).

2. Boot according to claim 1, wherein the rigid core comprises a shell (1) and a cuff (2) articulated on the shell (1).

3. Boot according to claim 2, wherein the means of reinforcement consists of a first back support (7) on the back of the cuff (2), and a second back support (5) on the back of the shell (1) of the boot.

4. Boot according to claim 1, wherein the rigid core comprises a shell (1) and a cuff (2) bound together.

5. Boot according to claim 4, wherein the means of reinforcement consists of a first back support (7) on the back of the cuff (2), and a second back support (5) on the back of the shell (1) of the boot.

6. Boot according to claim 1, wherein the means of reinforcement also comprises a diagonal reinforcement strip (4, 6, 9, 10) on at least one side of the boot.

7. Boot according to claim 6, wherein the means of reinforcement comprises a diagonal reinforcement strip (4, 6, 9, 10) on each side of the boot.

8. Boot according to claim 6, wherein the diagonal reinforcement strip is composed of two parts; the first part (4, 9) of the strip being located on the core (1) of the boot, and the second part (6, 10) of the strip being located on the cuff (2) of the boot.

9. Boot according to claim 1, comprising one support (3, 8) on at least one of the sides in the front of the shell (1) forming a pole deflector.

* * * * *